US005742980A

United States Patent [19]

Nitta

[11] Patent Number: 5,742,980

[45] Date of Patent: Apr. 28, 1998

[54] CONTINOUS HINGE FOR DOORS

[75] Inventor: Tomoharu Nitta, Sendai, Japan

[73] Assignee: Kabushikigaisha, ADD, Miyagi-ken, Japan

[21] Appl. No.: 743,357

[22] Filed: Nov. 4, 1996

[30] Foreign Application Priority Data

Nov. 13, 1995 [JP] Japan ..... 7-013463

[51] Int. Cl.[6] ..... E05D 1/04

[52] U.S. Cl. ..... 16/355

[58] Field of Search ..... 16/355, 356

[56] References Cited

U.S. PATENT DOCUMENTS

| | | | |
|---|---|---|---|
| 1,538,877 | 5/1925 | Baty | 16/355 |
| 1,912,635 | 6/1933 | Hall | 16/355 |
| 1,987,755 | 1/1935 | Hall | 16/335 |
| 3,633,244 | 1/1972 | Crossman | 16/355 |
| 3,696,463 | 10/1972 | Watson | 16/356 |
| 5,075,927 | 12/1991 | Porta | 16/355 |

FOREIGN PATENT DOCUMENTS

| | | | |
|---|---|---|---|
| 0681771 | 5/1930 | France | 16/355 |
| 1385625 | 12/1964 | France | 16/355 |
| 6506353 | 11/1966 | Netherlands | 16/355 |
| 0425200 | 3/1935 | United Kingdom | 16/355 |
| 1278496 | 6/1972 | United Kingdom | 16/355 |

*Primary Examiner*—Chuck Mah
*Attorney, Agent, or Firm*—Ronald R. Snider

[57] ABSTRACT

A seam-assembled continuous hinge for use on a door elbow which allows a door to be opened up to 180° without forming a space in the longitudinal direction and permits disposing plates in any optional directions on a bed for mounting a box-like outer frame to which the continuous hinge is to be attached. This continuous hinge is configured to allow a door to be opened up to 180° by coinciding an inner arc shape of a female type variable-diameter cylindrical portion 3 of a female type base plate 2 which is to be attached to a box-like outer frame 1 in which the universal fin plate 7 can be fitted and removed in optional directions with an outer arc shape of a male type variable-diameter cylindrical portion 4 of an integral door body 5 which is to be seam-assembled with the female type base plate and configuring the arc shape so as to be composed of a semicircle a located at a tip on a side of a center, and two arcs b and c which have progressively prolonged radii and centers located at different points, and are successive or adjacent to the semicircle a.

4 Claims, 4 Drawing Sheets

CONTINOUS HINGE FOR DOORS

BACKGROUND OF THE INVENTION

1. Field of the Invention

The present invention relates to a safe continuous hinge for doors which is seam-assembled for allowing a door to be opened 180° without disengaging the hinge nor forming a space in the longitudinal direction.

2. Description of the Prior Art

A hinge consisting of side attaching plates 51 and 52 which are supported at a center thereof by a shaft rod 50 and sectorially movable like butterfly wings is conventionally used on an elbow edge of a door as shown in FIG. 8. However, this hinge cannot maintain a room interior in an airtight condition since it allows, in any open or closed condition of the door, air leak through spaces S formed on both sides of the shaft rod 50 along edge lines of an outer frame and a door attached thereto. For solving this problem, Japanese Patent Application No. 6-185711 (hereinafter referred to as Reference 1) proposed a circular seam-assembled continuous hinge which does not allow such a space to be formed.

The circular seam-assembled hinge proposed by Reference 1 is a continuous hinge composed of a hook type base plate which is to be attached to a wall and an engaging plate which is to be attached to a door. In a section of this continuous hinge, the hook type base plate has an inner periphery configured in a semicircular hook shape, and an inner periphery of the engaging plate which is to slide on the semicircular hook portion in an inscribed condition is configured in a deformed arc shape consisting of a semicircle having a radius C, located on a side of a center and successive or adjacent to two arcs which have radii 2C and 3C respectively, and centers at different points. Since the outer perimetrical surface of the deformed arc portion of the engaging plate is brought into slide-contact with an inner perimetrical surface of the semicircle of the hook type base plate, it engages with a body of the engaging plate along a straight line in an area where the semicircular inner perimetrical surface of the semicircle of the engaging plate which is located on the side of the center is brought into slide-contact with an outer perimetrical surface of a goose-neck-shaped swollen portion formed on a tip of the semicircular hook portion. When the engaging plate is turned 90°, the portions of the base plate and the engaging plate which are to be kept in slide-contact are separated from each other and disengaged. Accordingly, the hinge cannot be opened to 180° since the outer perimetrical surface of the deformed arc portion which is not matched with the semicircular inner perimetrical surface cannot be inscribed in the inner perimetrical surface even if an attempt is made to open the hinge at an angle larger than 90°.

The continuous hinge proposed by Reference 1 has a defect that it is openable up to an angle only a little larger than 90°, or it cannot be opened fully to 180°.

BRIEF SUMMARY OF THE INVENTION

Object of the Invention

The present invention is an improvement for correcting the defect pointed out above and provides a safe continuous hinge which allows a door to be opened fully to 180° without disengagement thereof.

SUMMARY OF THE INVENTION

The continuous hinge improved by the present invention allows a door to be opened 180° without forming a space.

The continuous hinge according to the present invention consists of a female type base plate 2 which is to be fixed to a box-like outer frame 1 and has a female type variable-diameter cylindrical portion 3, and an integral door frame 5 attached to a door elbow formed integrally with a male type variable-diameter cylindrical portion 4 which is to be brought into slide-contact with the female type variable-diameter cylindrical portion 3 and has the same arc shape as that of the female type cylindrical portion 3. The female type base plate 2 is attached to the box-like outer frame 1 which permits free fitting and removal therein and therefrom of universal fin plates 7 for attachment to a bed 8 supporting a house wall 6. In a section of the female type variable-diameter cylindrical portion 3, it has uniform thickness, a goose-neck-shaped folded portion 9 formed at a tip on the side of the center and an inner variable-diameter periphery 10 consisting of a semicircle a successive or adjacent to two arcs b and c which have progressively prolonged radii and centers at different points, an outer variable-diameter periphery 11 which has the same shape as the inner variable-diameter periphery 10, and a swollen protruding strip 12 which is formed inside a root of the inner variable-diameter periphery 10. In a section of the male type variable-diameter cylindrical portion 4 which is formed integrally with a corner edge of the integral door frame 5, it has uniform thickness, a swollen protrusion portion 13 formed inside a tip which is folded and located on the side of the center, an outer sliding periphery 14 which has the same shape as the inner variable-diameter periphery 10 of the female type variable-diameter cylindrical portion 3 and a triangular protrusion 15 which is formed, as an extension, at a root of an inner periphery having the similar shape.

DETAILED DESCRIPTION OF THE PREFERRED EMBODIMENTS

Figure 1:
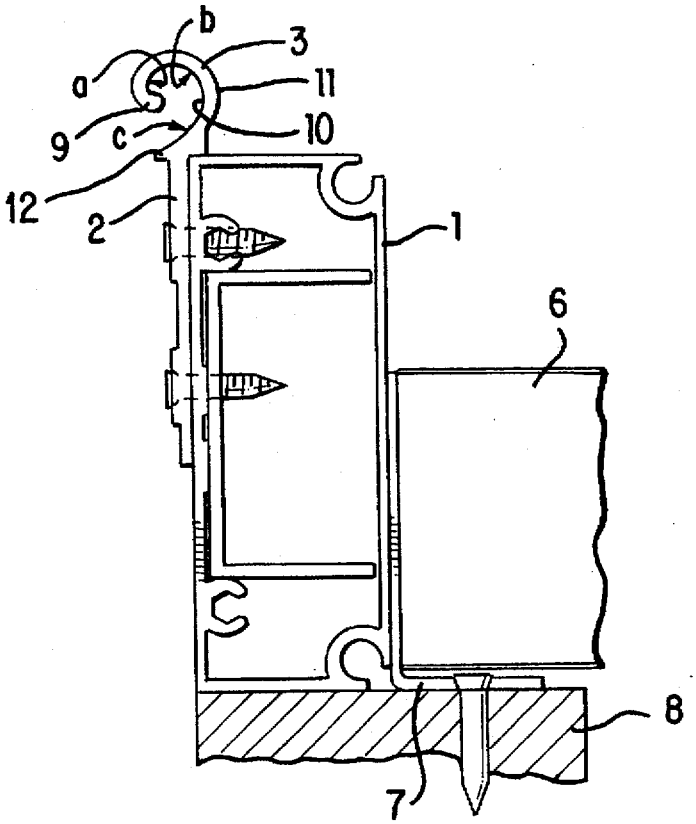
FIG. 1 is a plan view illustrating a female type variable-diameter cylindrical portion of the continuous hinge for doors according to the present invention.
Figure 2:
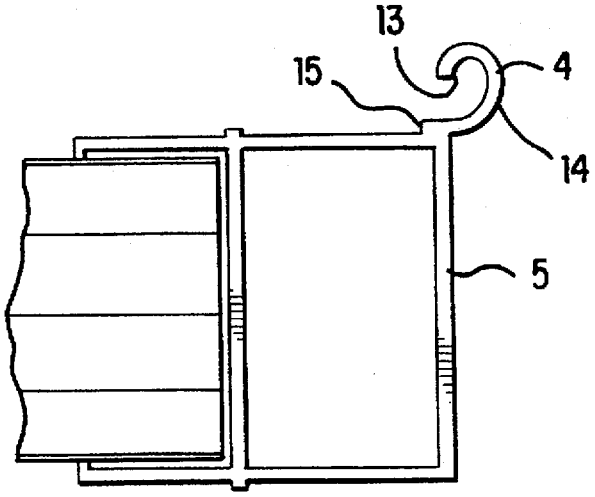
FIG. 2 is a plan view illustrating a male type variable-diameter cylindrical portion of the continuous hinge for doors according to the present invention.

The hinge for doors according to the present invention consists of a female type base plate 2 which has a female type variable-diameter cylindrical portion 3 and is to be attached to a box-like outer frame 1 mounted on a house wall, and an integral door frame 5 which has a male type variable-diameter cylindrical portion 4 formed integrally therewith and is to be attached to an elbow of a door body.

A seam-assembled continuous hinge is composed by longitudinally inserting the male type cylindrical portion 4 into the female type variable-diameter cylindrical portion 3. Differently from the conventional door hinge, the seam-assembled continuous hinge according to the present invention which is free from discontinuance does not allow a space to be formed by opening or closing a door. A plate portion of the female type base plate 2 eliminates the necessity to use a door back plate which is conventionally interposed between an end surface of a door and an outer plate, thereby making it possible to configure an outer frame as the box-like outer frame 1 which enhances strength of a door elbow. In addition the integral door frame 5 which is to be used for fixing a door body made of a heat insulating material is formed integrally with the male type variable-diameter cylindrical portion 4 and serves for extremely strengthening the door elbow.

Figure 3:
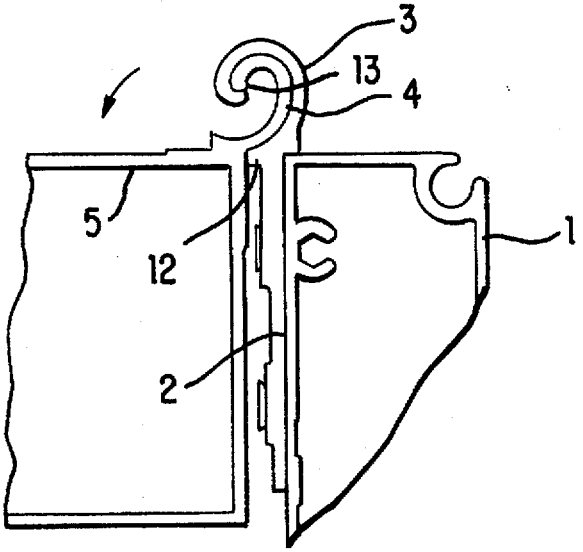
FIG. 3 is a plan view illustrating a combination of the female type and male type variable-diameter cylindrical portions in a condition for closing a door.

When the door is closed, the continuous hinge is completely stabilized since the outer sliding periphery 14 of the male type variable-diameter cylindrical portion 4 of the integral door frame 5 is brought into complete slide-contact with the inner variable-diameter periphery 10 of the female type variable-diameter cylindrical portion 3 of the female type base plate 2 as shown in FIG. 3. In this condition, the tip of the folded goose-neck portion 9 of the female type variable-diameter cylindrical portion 3 is engaged and wrapped with the swollen protrusion portion 13 formed at the tip located on the side of the center of the male type variable-diameter cylindrical portion 4 for stabilizing the continuous hinge. The swollen protruding strip 12 holds an end surface of the integral door frame 5 with a narrow gap for accepting displacement of the door body in the closed condition.

Figure 4:
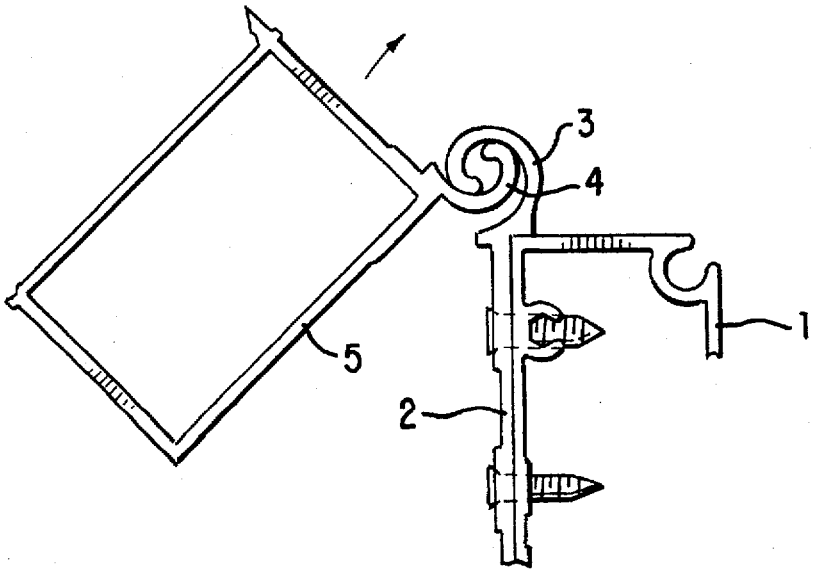
FIG. 4 is a plan view illustrating a sliding condition of the male type variable-diameter cylindrical portion in a course where the door is being opened.
Figure 5:
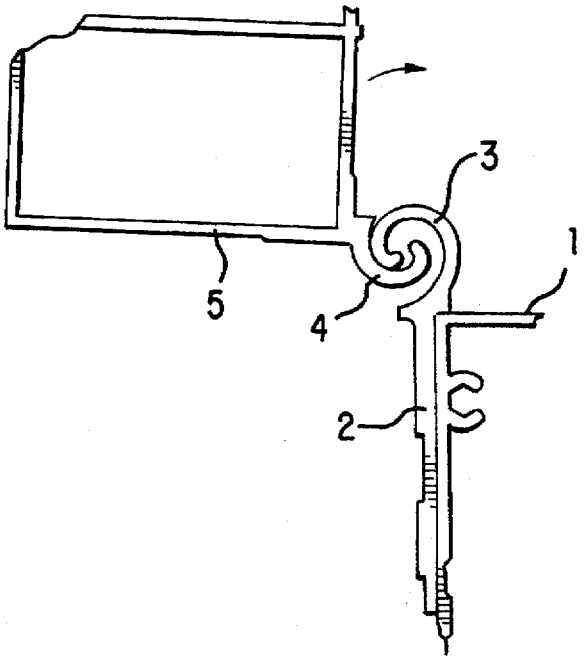
FIG. 5 is a plan view illustrating another sliding condition of the male type variable-diameter cylindrical portion in the course where the door is being opened.
Figure 6:
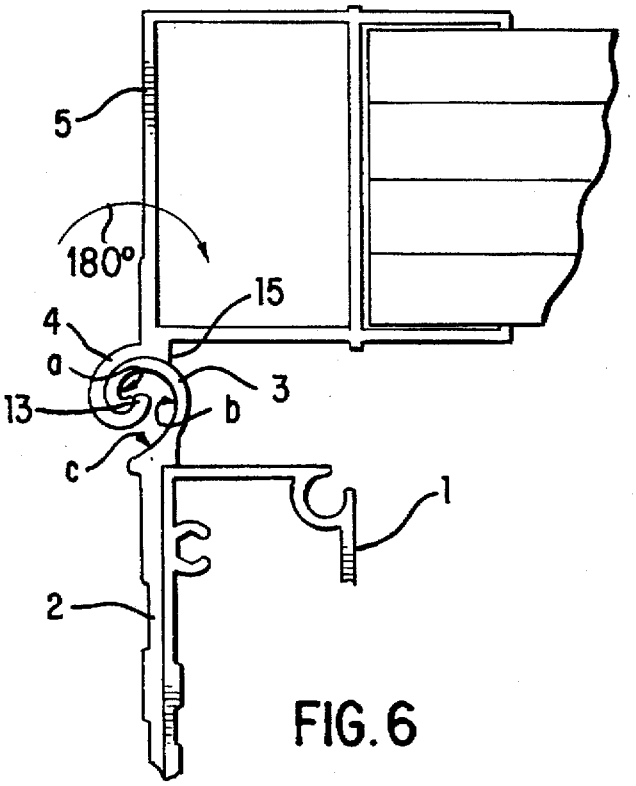
FIG. 6 is a plan view illustrating the combination of the female type and male type variable-diameter cylindrical portions in a condition where the door is opened at an angle of 180°.
Figure 7:
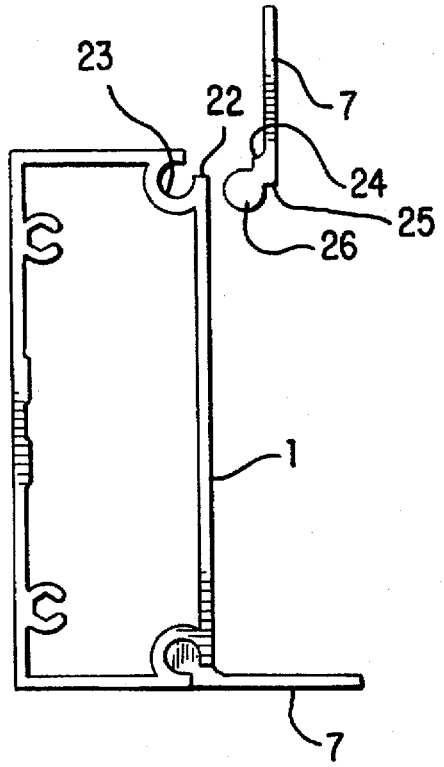
FIG. 7 is a plan view showing universal fin plates.
Figure 8:
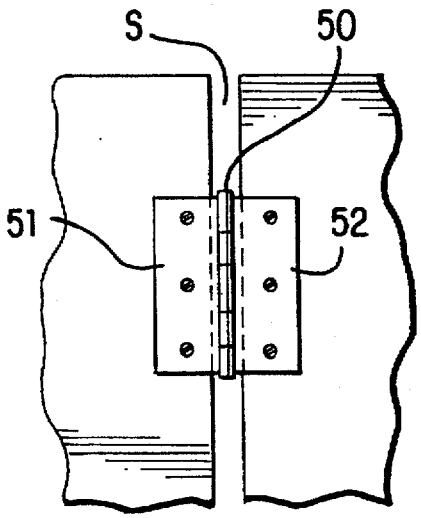
FIG. 8 is a front view illustrating a conventional hinge.

In a course where the door body is being opened in FIG. 4, the sliding outer periphery 14 allows the inner variable-diameter arc periphery 10 to slide while guiding it. As the door is opened wider, an outer periphery, which is located on the side of the center of the sliding outer periphery 14 of the male type variable-diameter cylindrical portion 4 and corresponds to the semicircle a of the female type variable-diameter cylindrical portion 3, is guided by the inner surface which is located at the root of the inner variable-diameter 10, and consists of the two arcs b and c having the progressively prolonged diameters and centers at the different points, until the inner periphery at the root of the male type variable-diameter cylindrical portion 4 contacts an outer periphery of the folded goose-neck portion 9 of the female type variable-diameter cylindrical portion 3, is disengaged leaving a space for motion between the variable-diameter arc peripheries as shown in FIG. 5 and continues sliding while being guided by the variable-diameter outer periphery 11, and the inner periphery of the male type variable-diameter cylindrical portion 4 is brought into close contact with the variable-diameter periphery 11 of the female type variable-diameter cylindrical portion 3 and stabilized owing to engagement between the swollen protrusion portion 13 and the triangular protrusion 15 in a condition where the door is open 180° without disengagement as shown in FIG. 6, thereby keeping the door open at 180°.

According to the present invention wherein the female type base plate 2 is to be attached to the box-like outer frame 1 which in turn is to be attached to the bed 8 used for supporting the house wall 6, the universal fin plates 7 can be fitted and removed in optional directions into and out of the box-like outer frame 1 dependently on mounting directions thereof.

Speaking more concretely, formed in two corners of the box-like outer frame 1 are semicylindrical openings 23 each having two right-angled cover plates 21 and 22 which are disposed in directions perpendicular to each other. The universal fin plate 7 having a cylindrical portion 26 swollen between two right-angled contact edges 24 and 25 disposed in directions perpendicular to each other is fitted in the vertical or horizontal direction as occasion demands. The box-like outer frame 1 can easily mounted in position by inserting the cylindrical portion 26 into the semicylindrical opening 23, bringing the right-angled contact edges 24 and 25 into contact with the right-angled cover plates 21 and 22 for stabilizing and fixing the universal fin plate 7, and fixing the universal fin plate 7 to the bed 8.

The seam-assembled continuous hinge according to the present invention allows a door to be opened fully to 180° without forming a space along a door elbow, assures high security by preventing users'hands from being caught by the door and provides an effect to mount a box-like outer frame in an optional direction on a bed by using universal fin plates.

What is claimed is:

1. A continuous hinge for a door and frame which allows a door to be opening 180° without forming a space between the door and the frame consisting of:

a female type base plate having a female type variable-diameter cylindrical portion which is to be attached to a box-like outer frame mounted on a house wall, and an integral door frame having a male type variable-diameter cylindrical portion which is formed integrally therewith and to be brought into slide-contact with an inner variable-diameter surface of said female type variable-diameter cylindrical portion, wherein said male type variable-diameter cylindrical portion has an outer perimetrical surface coincident with an inner variable-diameter perimetrical surface of said female type variable-diameter cylindrical portion consisting of a semicircle having a center, and two arcs which have progressively prolonged radii and having centers located at different points, and are successive or adjacent to said semicircle, and wherein said female type variable-diameter cylindrical portion is seam-assembled with said male type variable-diameter cylindrical portion.

2. A continuous hinge for doors according to claim 1, further-comprising universal fin plates which can optionally be fitted and removed into and out of semicylindrical openings formed in two corners of the box-like outer frame for attaching said female type base plate having the female type variable-diameter cylindrical portion.

3. A continuous hinge for doors according to claim 1 wherein said male-type variable diameter cylindrical portion has a same arc shape as that of the female-type cylindrical portion.

4. A continuous hinge for doors according to claim 1 wherein a swollen protruding strip is formed inside a root of the inner variable-diameter surface of said female type variable-diameter cylindrical portion.

* * * * *